US007005866B2

(12) United States Patent
Schroeder

(10) Patent No.: US 7,005,866 B2
(45) Date of Patent: Feb. 28, 2006

(54) APPARATUS AND PROCESS FOR DETECTING CONDENSATION IN A HEAT EXCHANGER

(75) Inventor: Joseph E. Schroeder, Union, MO (US)

(73) Assignee: Nooter Eriksen, Inc., Fenton, MO (US)

( * ) Notice: Subject to any disclaimer, the term of this patent is extended or adjusted under 35 U.S.C. 154(b) by 0 days.

(21) Appl. No.: 10/964,338

(22) Filed: Oct. 13, 2004

(65) Prior Publication Data

US 2005/0218912 A1 Oct. 6, 2005

Related U.S. Application Data

(60) Provisional application No. 60/557,626, filed on Mar. 30, 2004.

(51) Int. Cl.
*G01R 27/08* (2006.01)
*F28F 19/00* (2006.01)

(52) U.S. Cl. ..... 324/691; 324/693; 324/700; 165/11.1

(58) Field of Classification Search ..... 324/691, 324/693, 700; 165/113, 181, 183, 11.1
See application file for complete search history.

(56) References Cited

U.S. PATENT DOCUMENTS

| | | | | |
|---|---|---|---|---|
| 3,267,361 | A * | 8/1966 | Maddox | 324/439 |
| 3,976,121 | A * | 8/1976 | Johnson | 165/11.1 |
| 6,508,206 | B1 * | 1/2003 | Rechtman | 122/7 R |
| 2003/0184320 | A1 * | 10/2003 | Breen et al. | 324/691 |

* cited by examiner

*Primary Examiner*—Anjan Deb
*Assistant Examiner*—Amy He
(74) *Attorney, Agent, or Firm*—Polster, Lieder, Woodruff & Lucchesi L.C.

(57) ABSTRACT

A feedwater heater for an HRSG is provided with a monitoring unit for detecting the presence of condensation in the feedwater heater. The monitoring unit includes a dielectric band around one of the tubes of the feedwater heater near the location where the feedwater is directed into the heater and a conductive band located around the dielectric band. The unit also includes a conductivity sensor installed between a ground on the feedwater heater and the conductive element. Hot gases containing moisture pass through the feedwater heater, and if the temperature of surfaces in the region of the tube around which the dielectric and conductive bands extend drops below the dew point of the gas, an electrically conductive condensate will appear those surfaces and on the tube and will flow over the dielectric band, completing an electric circuit between the tube and the conductive band. The conductivity sensor detects this and hence detects the presence of the condensation.

15 Claims, 1 Drawing Sheet

APPARATUS AND PROCESS FOR DETECTING CONDENSATION IN A HEAT EXCHANGER

CROSS-REFERENCE TO RELATED APPLICATIONS

This application derives and claims priority from U.S. provisional application 60/557,626 filed Mar. 30, 2004.

STATEMENT REGARDING FEDERALLY SPONSORED RESEARCH

Not applicable.

BACKGROUND OF THE INVENTION

This invention relates in general to heat exchangers and, more particularly, to a process and apparatus for detecting condensation in a heat exchanger.

Natural gas represents a significant source of electrical energy in the United States. It burns with few emissions, and is available throughout much of the country. Moreover, the plants which convert it into electrical energy are efficient and, in comparison to hydroelectric projects and coal-fired plants, they are relatively easy and inexpensive to construct. In the typical plant, the natural gas burns in a gas turbine which powers an electrical generator. The exhaust gases—essentially carbon dioxide and steam—leave the gas turbine at about 1200° F. (649° C.) and themselves represent a significant source of energy. To harness this energy, the typical combined cycle, gas-fired, power plant also has a heat recovery steam generator (HRSG) through which the hot exhaust gases pass to produce steam which powers a steam turbine which, in turn, powers another electrical generator. The exhaust gases leave the HRSG at temperatures on the order of 150° F. (66° C.).

The HRSG basically comprises a series of heat exchanges housed in a duct. Water which is derived from condensing steam discharged from the steam turbine enters the HRSG at a feedwater heater where it undergoes a rise in temperature. The higher temperature water then flows into an evaporator where it is converted into steam, most if not all saturated steam. That steam flows into a superheater which converts it into superheated steam, and the superheated steam flows on to the steam turbine to power it. The hot gases derived from the combustion flow in the opposite direction, encountering the superheater, then the evaporator, and finally the feedwater heater.

Thus, the gases are at their coolest temperatures in the region of the feedwater heater and beyond. Natural gas contains traces of sulfur, and during the combustion the sulfur combines with oxygen to produce oxides of sulfur. Moreover, the combustion produces ample quantities of water in the form of steam. If the exhaust gases remain above the dew point for the gases, which is about 107° F. (42° C.), the oxides of sulfur pass out of the HRSG and into a flue. However, the low temperature feedwater has the capacity to bring the tubes at the downstream end of the feedwater heater below the dew point of the water in the exhaust gases, and when this occurs, water condenses on tubes. The oxides of sulfur in the flue gas unite with that water to form sulfuric acid which is highly corrosive. Other acids may likewise form.

In order to deter the formation of acids, operators of HRSGs control the temperature of the water entering the feedwater heater, so that it remains well above the dew point for the gases. This assures that no condensation occurs in the feedwater heater. And to be safe, the temperature of the entering water needs to be high, because the dew point temperature of the gases is difficult to predict in that it is a function of several parameters. If the temperature of the entering water could be lowered, the water would extract more energy from the gases, and they would pass beyond the feedwater heater at a lower temperature.

The problem of condensation in feedwater heaters or economizers is not confined solely to HRSGs installed downstream from gas turbines. Indeed, it can occur almost anywhere energy is extracted from hot gases flowing though a duct to heat the feedwater for a boiler. For example, many power plants convert the hot gases derived from the combustion of fossil fuels, such as coal or oil, directly into steam, and the boilers required for the conversion, to operate efficiently, should have feedwater heaters—heaters which should not produce condensation. Also, systems exist for producing steam from the hot gases derived from the incineration of waste, and they likewise have boilers including feedwater heaters that should not be subjected to condensation.

DETAILED DESCRIPTION OF THE INVENTION

Figure 1:
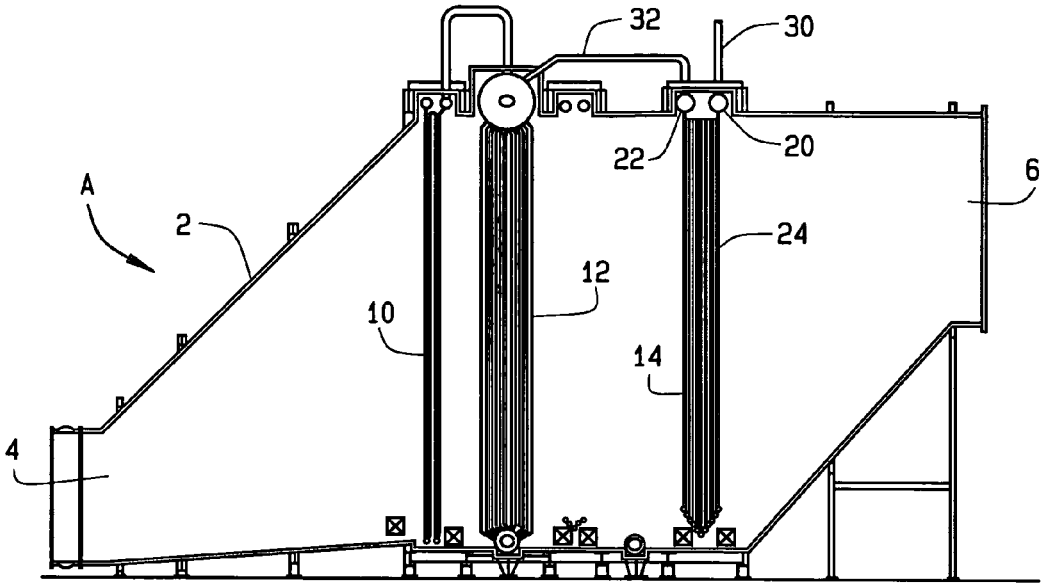
FIG. 1 is a schematic sectional view of an HRSG having a feedwater heater provided with a monitoring unit constructed in accordance with the present invention.

Referring now to the drawings a heat recovery steam generator (HRSG) A (FIG. 1) contains a dew point monitoring unit B (FIG. 2) which provides the HRSG A with a system that detects the presence of condensation in the HRSG A and produces and alarm or other signal. This enables the operator of the HRSG A to control the temperature of water entering the HRSG A so that surfaces within the HRSG A remain above the temperature at which condensate will form on them, yet not excessively above that temperature.

The HRSG A includes a duct 2 having an inlet end 4 and a discharge end 6 which leads into a stack or flue. Hot gases derived from the combustion of natural gas or some other fuel enter the duct 2 at the inlet end 4, pass through it, and leave at the discharge end 6. The gases contain carbon dioxide and steam and trace mounts of compounds which if united with liquid water can form corrosive substances such as acids.

Figure 2:
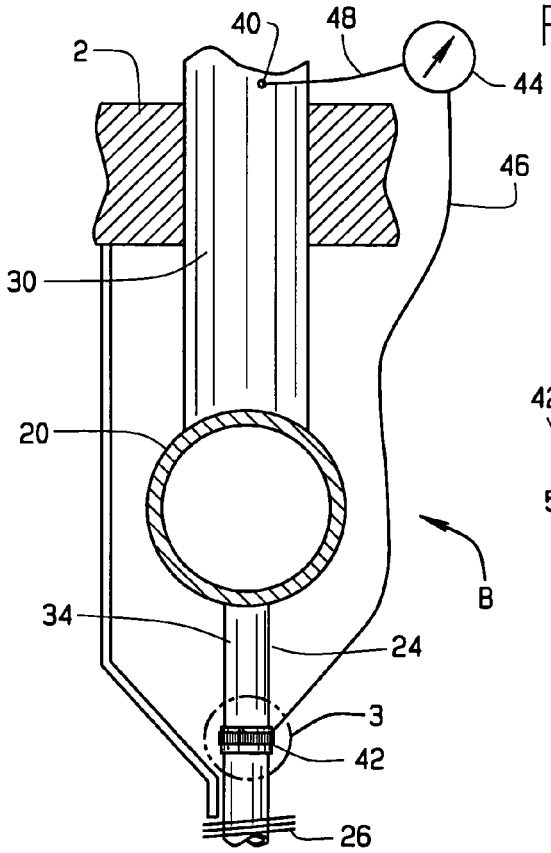
FIG. 2 is a fragmentary sectional view of the feedwater heater at the monitoring unit.

In addition to the duct 2, the HRSG includes several heat exchangers that are housed in succession within the duct 2 (FIG. 1). Each has tubes made from low carbon steel and fins around the tubes. First, the gases flow through a superheater 10, then through an evaporator 12, and finally through a feedwater heater 14, sometimes called an economizer. Water flows through these heat exchangers in the opposite direction. It enters the feedwater heater 14 as a liquid, where its temperature is elevated. The higher temperature water flows from the feedwater heater 14 into the evaporator 12 where it is converted into steam, mostly if not all saturated steam. The saturated steam enters the superheater 10 where it becomes superheated steam. The temperature of the gases drops as the gases pass through the superheater 10, the evaporator 12 and the feedwater heater 14 and are at their coolest temperatures in the region of the feedwater heater 14 and beyond. To prevent the formation of corrosive acids, the temperature of surfaces within the feedwater heater 14 must remain above the dew point for the gases in the duct 2. Typically, that temperature is about 107° F. (42° C.), but it does vary. Moreover, the dew point of the gases is difficult to predict, because it represents a function of several parameters.

The operator of the HRSG A maintains a measure of control over the temperature of the feedwater that enters the feedwater heater 14. Preferably, that temperature should be low to extract maximum heat from the gases flowing through the duct 2, yet it should remain above the dew point of the gases to avoid condensation from developing in the feedwater heater 14. The monitoring unit B enables the operator of the HRSG to achieve these objectives.

The feedwater heater 14 includes (FIG. 1) a header 20 and a collector 22, as well as a succession of tubes 24 that extend vertically through the duct 2, generally occupying the entire cross sectional area of the duct 2, so that the hot gases must flow over them. All are formed from a metal, such as a low carbon steel and, of course, will conduct an electrical current. The header 20 extends across the duct 2 at the top of the duct 2, and the collector 22 may do so as well, although in the alternative it may be in the bottom of the duct 2. One end of each tube 24 is connected to the header 20 and the other end is connected to the collector 22. The tubes 24 are fitted with fins 26 (FIG. 2) which enhance the transfer of heat from the hot gases to the tubes 24 themselves and to the water within the tubes 24. In addition, the feedwater heater 14 has an inlet 30, which is connected to a source of feedwater and opens into the header 20, and an outlet 32 which leads away from the collector 22 and is connected to the evaporator 12. The relatively cool feedwater enters the header 20 through the inlet 30 and from the header 20 flows into the tubes 24 where it is heated by the hot gases and thus undergoes a rise in temperature. The heated feedwater flows from the tubes 24 into the collector 22 and thence into the outlet 32 which delivers it to the evaporator 12. The surfaces of the inlet 30 and header 20 have the lowest temperatures of any surfaces in the feedwater heater 14, and the same generally holds true for the tubes 24 where they are connected to the header 20. One of the tubes 24, preferably the one closest to the inlet 26, immediately below its connection to the header 20 possess a bare surface 34 (FIG. 2) that is devoid of fins 26. Indeed, the bare surface 34 extends vertically between the header 20 and the first fins 26 on that tube 24.

The monitoring unit B basically comprises (FIG. 2) a ground terminal 40 somewhere on the metal feedwater heater 14, preferably on the inlet 30, and an actuating terminal 42 on the bare surface 34 of the one tube 24. In addition, the monitoring unit B includes a conductivity meter 44 connected between the ground terminal 40 and the actuating terminal 42 with electrical leads 46 and 48, respectively. The arrangement is such that the conductivity meter 44 will detect the completion of an electrical circuit between the ground terminals 40 and actuating terminal 42.

Figure 3:
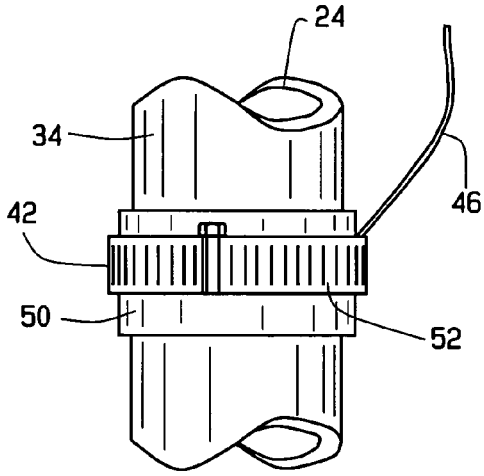
FIG. 3 is an enlarged view of the activating terminal for the monitoring unit.

The actuating terminal 42 includes (FIG. 3) a dielectric band 50 which encircles the bare surface 34 of the one tube 24 slightly above the first fin 26 on that tube, it being spaced downwardly from the header 20. Indeed, the spacing between the lower surface of the header 20 and the upper margin of the dielectric band 50 should be no greater than about 24 inches (62 cm). Moreover, the dielectric band 50 should be formed from a nonporous substance, so that it does not absorb condensate and of course it should withstand the temperatures to which the feedwater heater 14 is subjected. In addition to the dielectric band 50, the activating terminal 42 includes an electrically conductive band 52 which surrounds the dielectric band 50, tightly embracing the dielectric band 50 and retaining itself and the dielectric band 50 in a fixed position around the tube 24 without actually contacting the tube 24. The conductive band 52 is formed from metal, preferably one, such as stainless steel, which resists corrosion but of course conducts electrical current. It may take the form of a pipe clamp. The electrical lead 46 is attached to the conductive band 52 and is thus electrically isolated from the tube 24 and the remainder of the feedwater heater 14. Indeed, its end, with insulation stripped from it, may be simply inserted beneath the conductive band 52 and clamped against the dielectric band 50 by the conductive band 52.

In the operation of the HRSG A, hot gases, the products of combustion of a fuel, such as natural gas, enter the duct 2 at its inlet end 4. Here the gases exist at an extremely high temperature on the order of 1200° F. (649° C.). The gases pass through the superheater 10 where heat is extracted from them and then through the evaporator 12 where more heat is extracted. The temperature of the gases drops appreciably. When the gases encounter the feedwater heater 14 the temperature may have dropped to between 300° F. (149° C.) and 200° F. (93° C.). The dew point for the gases, although difficult to predict, is on the order of 107° F. (42° C.), so the surfaces of the feedwater heater 14 should remain above the dew point. Yet the feedwater 14 should maintain the surfaces of the feedwater heater 14 at a temperature only slightly above the dew point of the gases, perhaps 5° F. (2.8° C.) above the dew point. This enables the HRSG A to extract the maximum amount of heat from the gases without producing condensation and the corrosion that it causes. And the operator of the HRSG A does maintain a measure of control over the temperature of the water that enters the feedwater heater 14.

Thus, to insure that the HRSG A operates most efficiently, the operator reduces the temperature of the feedwater while monitoring the conductivity meter 44. As long as no condensation develops on the header 20 or the nearby regions of the tubes 24, the conductivity meter 44 will not register an alarm or other signal. However, should the feedwater cool the header 20 and nearby regions of the tubes 24 to a temperature below the dew point of the gases, the moisture in the gases will condense on the header 20 and on the bare surface 34 of the one tube 24 and will flow downwardly over the upper margin of the dielectric band 50 and along the surface of the band 50 to the conductive band 52. It completes an electrical circuit between the bare section 34 of the one tube 24 and the conductive band 52. The conductivity meter 44 registers the completion of the circuit, thereby notifying the operator of the HRSG A that the temperature of the feedwater is too low. The operator can adjust the temperature of the feedwater upwardly in increments until the conductivity meter 44 no longer registers the presence of a circuit. This of course denotes the absence of a condensate.

Variations are possible. For example, the activating terminal 42 need not be on a tube 24, but may be on some other surface, such as the side of the header 20, where condensation will also occur. Irrespective of the location of the actuating terminal 42, its dielectric and conductive elements need not extend completely around the surface on which it is mounted. Moreover, the HRSG A is depicted in its simplest form. It may include additional superheaters, evaporators and even feedwater heaters. The monitoring unit B may be used on heat exchanges other than feedwater heaters in HRSGs. Any instrument or sensor capable of detecting conductivity will suffice for the conductive meter 44. Also, the monitoring unit B may be installed on an evaporator, such as the evaporator 12. Should the unit B, when so installed, detect condensate, the operator can raise the evaporator boiling temperature.

PARTS LIST

Apparatus and Process for Detecting Condensation in a Heat Exchanger

A HRSG
B monitoring unit
2 duct
4 inlet end
6 outlet end
10 superheater
12 evaporator
14 feedwater heater
20 header
22 collector
24 tubes
26 fins
30 inlet
32 outlet
34 bare surface
40 ground terminal
42 activating terminal
44 conductivity meter
46 electrical lead
48 electrical lead
50 dielectric band
52 conductive band

What is claimed is:

1. The combination comprising:

a heat exchanger into which liquid water flows and through which a hot gas having a dew point passes so that heat transfers from the gas to the water, the heat exchanger being formed from an electrically conductive material and having a surface along which a conductive condensate will form if the temperature of the surface falls below the dew point of the gas;

a dielectric element adjacent to the surface;

a conductive element over the dielectric element and normally being electrically isolated from the heat exchanger by the dielectric element; and a monitoring device for detecting electrical conductivity between the heat exchanger and the conductive element;

whereby when a conductive condensate flows over the dielectric element and bridges the space between the surface on the heat exchanger and the conductive element, the monitoring device will sense electrical conductivity through the condensate and hence the presence of the condensate.

2. The combination according to claim 1 wherein the surface is on a tube.

3. In combination with an HRSG including a duct through which a gas having a dew point flows, with the gas being capable of producing a condensate that is electrically conductive;

a superheater located in the duct;

an evaporator located in the duct downstream from the superheater;

and a feedwater heater located in the duct downstream from the evaporator;

a monitoring system comprising:

a surface on the feedwater heater over which the condensate will flow;

a dielectric element located over the surface;

a conductive element located over the dielectric element and normally being isolated from the surface by the dielectric element; and a monitoring device for detecting the presence of an electrical circuit between the feedwater heater and the conductive element.

4. The combination according to claim 3 wherein the feedwater heater has an inlet through which feedwater is introduced into the feedwater heater, and the surface is near the inlet.

5. The combination according to claim 3 wherein the feedwater heater has a header into which the feedwater is introduced and tubes leading from the header, and wherein the surface is on one of the tubes leading from the header.

6. The combination according to claim 5 wherein the tubes of the feedwater heater extend generally vertically.

7. The combination according to claim 6 wherein the header is located above the tubes.

8. The combination according to claim 7 wherein the distance between the header and the dielectric element is no greater than 24 inches.

9. The combination according to claim 6 wherein the dielectric element extends around the tube and the conductive element extends around the dielectric element.

10. The combination according to claim 6 wherein the monitoring device is a conductivity meter and leads connecting the conductivity meter to a ground terminal on the feedwater heater and to the conductive element.

11. A process for detecting electrically conductive condensate in a feedwater heater, said process comprising:

installing a dielectric element on a surface of the feedwater heater near the location where condensation is likely to occur;

installing a conductive element over the dielectric element such that the dielectric element normally isolates the conductive element from the surface;

monitoring electrical conductivity between the surface and the conductive element.

12. The process according to claim 11 wherein the surface rises above the dielectric element and the conductive element.

13. The combination comprising:

a heat exchanger through which a gas having a dew point passes, the heat exchanger being formed from an electrically conductive material and having a tube that extends substantially vertically and has a surface along which a conductive condensate will form if the temperature of the surface falls below the dew point of the gas;

a dielectric element adjacent to and below the surface on the tube;

a conductive element below the surface on the tube and over the dielectric element and normally being electrically isolated from the heat exchanger by the dielectric element; and a monitoring device for detecting electrical conductivity between the heat exchanger and the conductive element;

whereby when a conductive condensate flows over the dielectric element and bridges the space between the surface on the heat exchanger and the conductive element, the monitoring device will sense electrical conductivity through the condensate and hence the presence of the condensate.

14. The combination according to claim 13 wherein the dielectric element extends around the tube and the conductive element extends around the dielectric element.

15. The combination according to claim 14 wherein the monitoring device is a conductivity meter.

* * * * *